United States Patent [19]

Phillips

[11] 3,941,108

[45] Mar. 2, 1976

[54] IGNITION BOOSTER

[76] Inventor: John P. Phillips, 625 Ester St., Michigan, Ind. 46360

[22] Filed: July 29, 1974

[21] Appl. No.: 492,866

[52] U.S. Cl. .... 123/148 E; 123/148 CC; 123/148 P

[51] Int. Cl.[2] ..... F02P 9/00

[58] Field of Search ..... 123/148 MC, 148 E, 148 P

[56] References Cited

UNITED STATES PATENTS

| | | | |
|---|---|---|---|
| 2,189,913 | 2/1940 | McCarty | 123/148 P |
| 3,216,408 | 10/1965 | Byles | 123/148 E |
| 3,217,216 | 10/1965 | Dotto | 123/148 E |
| 3,259,118 | 7/1966 | Peters | 123/148 E |
| 3,280,809 | 10/1966 | Issler | 123/148 E |
| 3,288,125 | 10/1966 | Guyton et al. | 123/148 E |
| 3,500,809 | 3/1970 | Hohne et al. | 123/148 MC |
| 3,646,667 | 3/1972 | Janisch | 123/148 MC |

*Primary Examiner*—Wendell E. Burns
*Assistant Examiner*—James W. Cranson, Jr.
*Attorney, Agent, or Firm*—Hill, Gross, Simpson, Van Santen, Steadman, Chiara & Simpson

[57] ABSTRACT

Improved ignition systems for substantially increasing the gas mileage and boosting the voltage utilizing a standard magneto and isolated breaker points and an additional condenser. In one embodiment, the secondary of the magneto has been separated from the primary and a condenser has been added in the secondary winding. Another embodiment separates the secondary and primary windings and adds a condenser in the secondary.

5 Claims, 3 Drawing Figures

IGNITION BOOSTER

BACKGROUND OF THE INVENTION

1. Field of the Invention

This invention relates in general to ignition systems and in particular to improved high voltage ignition systems.

2. Description of the Prior Art

Under the present fuel shortage conditions, it is desirable to obtain maximum gasoline mileage from the operation of vehicles. Gasoline mileage depends on the efficiency of the engine which in turn depends upon the ignition system and thus by improving the ignition system, the efficiency of the engine can be increased.

SUMMARY OF THE INVENTION

The present invention comprises modifications of standard magneto and battery ignition systems which substantially increases the gas mileage and boosts the voltage to the spark plugs. In one embodiment, a standard magneto is connected so that the breaker points are isolated and an additional condenser is added into the circuit. A modification comprises separating the secondary from the primary in a standard magneto and adding a condenser in the secondary winding. A further modification comprises separating the primary and secondary windings and adding a condenser in the secondary so as to increase the capacitance and also reduce the arcing at the breaker points.

Other objects, features and advantages of the invention will be readily apparent from the following description of certain preferred embodiments thereof, taken in conjunction with the accompanying drawing, although variations and modifications may be effected without departing from the spirit and scope of the novel concepts of the disclosure, and in which:

BRIEF DESCRIPTION OF THE DRAWING

FIG. 1 illustrates an ignition system according to the invention.

DESCRIPTION OF THE PREFERRED EMBODIMENTS

Figure 2:
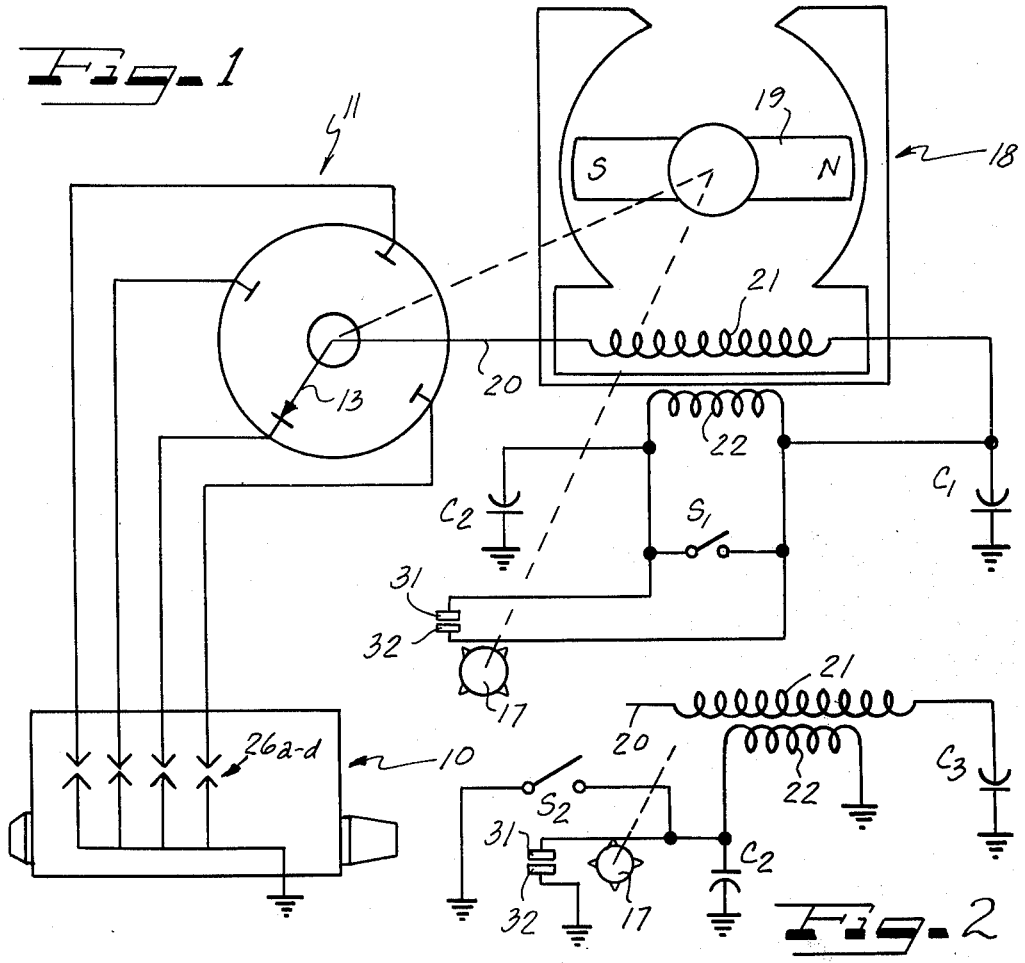
FIG. 2 illustrates a modification of the ignition system of the invention.

FIG. 1 illustrates an internal combustion engine 10 which has spark plugs 26*a–d* which are connected to a distributor 11 having a rotor 13. A magneto 18 has its rotor 19 driven with the distributor rotor 13. The secondary 21 of the magneto has one end connected to the distributor rotor 13 and the other side connected to a condenser $C_1$ which has its other side connected to ground. A primary winding 22 is connected to the points 31 and 32 which are controlled by the cam 17 driven by the engine with the magneto rotor 19 and the distributor rotor 13. One end of the primary 22 and point 31 is connected to one side of condenser $C_2$ which has its other side connected to ground. The other end of the primary 22 is connected to the ungrounded side of capacitor $C_1$. A switch $S_1$ is connected across the primary 22. The circuit of FIG. 1 comprises a standard magneto wherein the breaker points have been isolated and a condenser has been added into the circuit. This increases the capacitance which is indicated by increased voltage at the spark plugs 26 thus giving more efficient ignition.

FIG. 2 is a modification of the invention illustrated in FIG. 1, wherein the secondary 21 of the magneto is connected to a condenser $C_3$ which has its other side connected to ground but the primary 22 is not connected to the condenser $C_3$ but has one side grounded and its other side connected to the condenser $C_2$ and to point 31. The other point 32 is connected to ground. A switch $S_2$ is connected between point 31 and ground. Lead 20 connects to the rotor 13 as in FIG. 1 and the other portions of the ignition system are similar to those illustrated in FIG. 1 and are not shown.

In the circuit of FIG. 2 by separating the secondary from the primary and adding a condenser $C_3$ in the secondary winding, a substantial increase in spark is obtained which increases the efficiency of operation of the engine.

Figure 3:
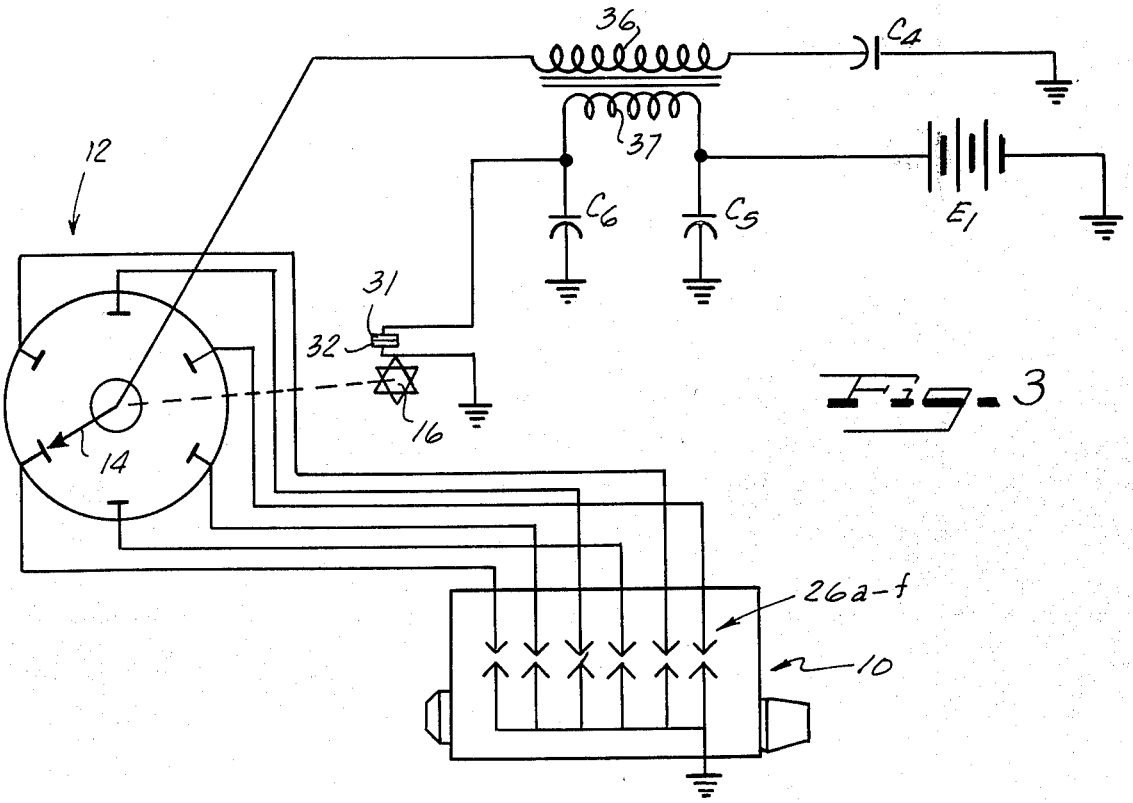
FIG. 3 illustrates a further modification of the invention.

FIG. 3 illustrates a modification of the invention where the distributor 12 has a rotor 14 which is connected to the secondary 36 which has its other side connected to a condenser $C_4$ which has its other side connected to ground. A battery El has its negative terminal connected to ground and its positive terminal connected to one end of the primary 37 and to one side of a condenser $C_5$ which has its other side connected to ground. A condenser $C_6$ is connected between ground and the other end of the primary 37. The breaker points 32 and 31 are actuated by cam 16 which is driven with the rotor 14 of the distributor. Point 32 is connected to ground and point 31 is connected to the junction point between capacitor $C_6$ and primary 37.

In operation, the circuit of FIG. 3 has the secondary and primary windings separated and adds the condenser $C_4$ so as to substantially increase the capacitance. I have found that this increases the capacitance as well as reduces the arc on the breaker points.

It has been discovered that the ignition systems of this invention greatly increase gas mileage and boosts the voltage to around 35,000 volts at the spark plugs.

Although the invention has been described with respect to preferred embodiments, it is not to be so limited as changes and modifications may be made which are within the full intended scope as defined by the appended claims.

I claim as my invention:

1. An ignition system for an engine comprising a magneto having a rotor and primary and secondary windings, a pair of breaker points connected across said primary winding and periodically opened and closed, a first capacitor connected between ground and one end of said primary winding, a distributor with a rotor to which one end of said secondary winding is connected, a second capacitor connected between the other end of said secondary winding and ground, and said distributory rotor, magneto rotor and said breaker points actuated by said engine.

2. An ignition system according to claim 1 wherein the other end of said primary winding is connected to the other end of said secondary winding.

3. An ignition system according to claim 1 including a switch connected across said primary winding.

4. An ignition system according to claim 1 wherein the other end of said primary winding is connected to ground.

5. An ignition system for an engine comprising, a distributor with a rotor, an ignition coil with primary and secondary windings, a first capacitor connected between one end of said secondary winding and ground, the other end of said secondary winding connected to said distributor rotor, a pair of breaker points actuated by said engine and connected between ground and one end of said primary winding, a voltage source connected between ground and the second end of said primary winding, a second capacitor connected between ground and said one end of said primary winding, and a third capacitor connected between ground and said second end of said primary winding.

* * * * *